United States Patent [19]

Green et al.

[11] Patent Number: 4,496,055

[45] Date of Patent: Jan. 29, 1985

[54] APPARATUS FOR FORMING GROUPS OF CIGARETTES

[75] Inventors: Robert J. Green; Dennis Hinchcliffe, both of London, England

[73] Assignee: Molins PLC, London, England

[21] Appl. No.: 425,365

[22] Filed: Sep. 28, 1982

[51] Int. Cl.[3] ..... A24C 5/48; B07C 5/00; B07C 5/342

[52] U.S. Cl. ..... 209/536; 131/282; 131/905; 131/907; 209/535

[58] Field of Search ..... 131/907, 282, 96, 905, 131/904, 909, 908, 283; 209/535–537; 53/54

[56] References Cited

U.S. PATENT DOCUMENTS

| | | | |
|---|---|---|---|
| 2,945,587 | 7/1960 | Bell et al. | 131/907 |
| 3,034,645 | 5/1962 | Groppe | 131/904 |
| 3,189,178 | 6/1965 | Calleson et al. | 131/908 |
| 3,729,636 | 4/1973 | Merker | 131/908 |
| 3,789,744 | 2/1974 | Wahle | 131/909 |

FOREIGN PATENT DOCUMENTS

| | | | |
|---|---|---|---|
| 2070545 | 9/1981 | United Kingdom | 131/282 |

*Primary Examiner*—V. Millin
*Assistant Examiner*—Gregory Beaucage
*Attorney, Agent, or Firm*—John C. Smith, Jr.

[57] ABSTRACT

A cigarette packing machine with a plurality of passageways leading from a hopper, includes an ends testing device (16, 16*a*) for individual cigarettes, so that faulty cigarettes can be rejected from the hopper before the cigarettes are ejected in groups at the bottom of the passageways (2).

Leading from the hopper are two channels (6, 8) feeding each of the passageways. In one embodiment of the invention cigarettes are held up for ends testing in alternate channels by suction ports (14) formed in inclined surfaces leading to each passageway. In a second embodiment a set of horizontal reciprocating wires (30, 32) acts as an escapement mechanism.

9 Claims, 3 Drawing Figures

APPARATUS FOR FORMING GROUPS OF CIGARETTES

This invention relates to apparatus for forming groups of cigarettes, and more particularly to a hopper in which cigarettes are inspected before being formed into groups.

In cigarette packing machines it is usual to inspect the cigarettes either immediately before or after they are formed into groups for packaging. For example in the Molins HLP4 packing machine this is done by testing successive arrays of cigarettes upstream of where they are ejected by a pusher from the vanes of a hopper to form the cigarette groups. If any cigarette is found faulty the whole respective group comprising the faulty cigarette is subsequently automaticaly rejected in the packing machine, often with at least some of the packaging materials. Clearly this results in a large wastage of good materials, particularly of cigarettes.

It is an object of the present invention to provide apparatus in which such wastage of materials is minimised.

According to the invention there is provided apparatus for forming groups of cigarettes, comprising a plurality of downwardly directed passageways each for containing a column of horizontal cigarettes, means for ejecting cigarettes at the bottom of the passageways to form groups of cigarettes, a cigarette hopper mounted above the passageways, a pair of channels extending between each passageway and said hopper, each channel having an exit leading to the associated passageway, an escapement device at said exits to each pair of channels which is operable to release single cigarettes from alternate exits, testing means in each channel for checking cigarettes for faulty ends, and rejection means at or above each said escapement device for rejecting faulty cigarettes.

Other features of the invention are defined in the appended claims.

Two examples of the invention will now be specifically described with reference to the accompanying drawings in which.

Figure 1:
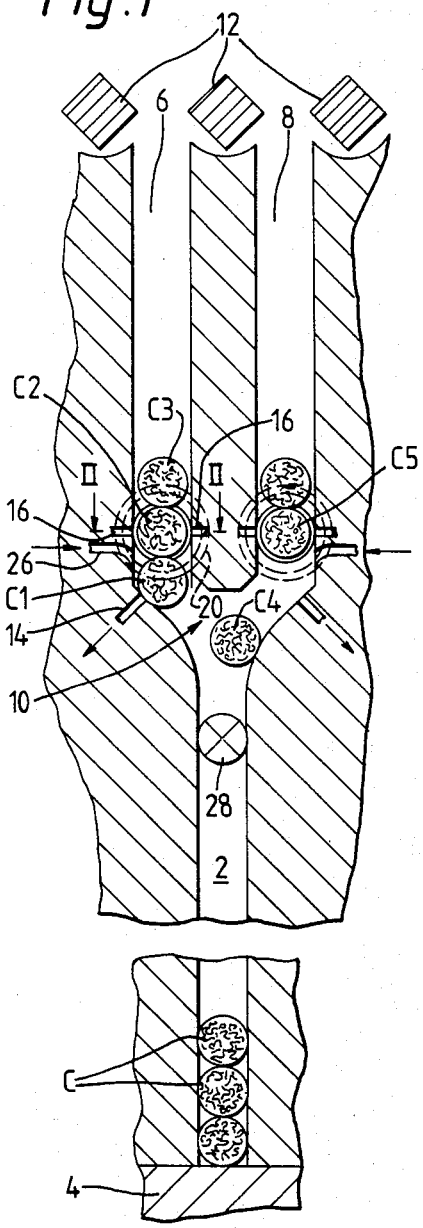
FIG. 1 is a sectional side view of a first embodiment of the invention.
Figure 2:
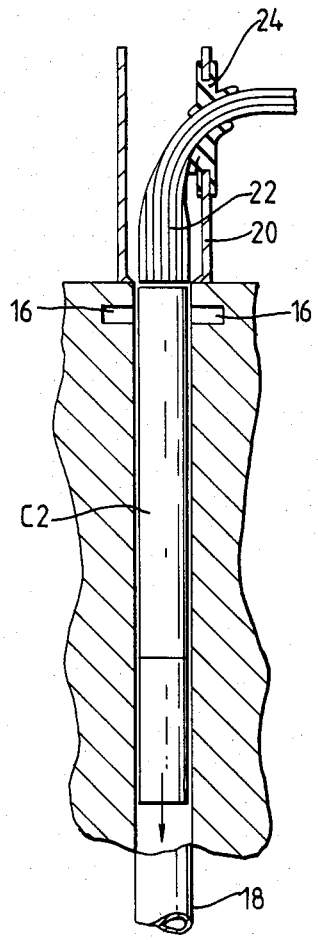
FIG. 2 is a section taken on the line II—II in FIG. 1.

Referring first to the embodiment of FIGS. 1 and 2, there is shown the central one of seven passgeways 2, each accommodating a column of cigarettes C. There are three similar, though inclined, passageways at each side of the one shown, so that the passageways taper downwardly together over a bed plate 4. Immediately above the bed plate 4 is known pusher arrangement (not shown) for ejecting two cigarettes at a time from one of the seven passageways and three from the remaining six passageways to form a group of twenty cigarettes in a 7-6-7 quincux collation.

At the top of each passageway 2 are two vertical channels 6 and 8 which are similar in width to the passageway 2 and merge together at a Y-shaped junction 10 into the passageway 2. At the entrance between the two channels 6 and 8, and likewise between these channels and the channels of the other six passageways, there are known, generally square-shaped, agitating rollers 12, which are driven in an oscillating manner backwards and forwards to urge cigarettes from a hopper (not shown) above the rollers into the channels 6 and 8.

At the two sides of the Y-shaped junction 10 are similar, only the left-hand half of the junction associated with the channel 6 will be described, and reference characters for the right-hand half have been omitted.

At the bottom of the channel 6 the outer side wall is inwardly inclined towards the passageway 2, providing a sloping surface in which is formed a suction aperture 14. When suction is applied to the aperture a cigarette C1 descending by gravity towards the bottom of the channel 6 is attracted and held against the aperture. With the cigarette C1 so held, the next succeeding cigarette C2 above cigarette C1 is disposed between a pair of photo-electric cells 16, which are thus directed diametrically across the tobacco end of the cigarette C2 (see FIG. 2). At axially opposite ends of the cigarette C2, in the position shown, are positioned an outlet tube 18 and a larger inlet tube 20 at the filter end and tobacco end respectively. Also immediately facing the tobacco end of the cigarette C2 is a fibre optic bundle 22, which passes out of the tube 20 through a sealed opening 24 and leads to a light detector (not shown) constituting a detector device. The tube 20 is connected via a fast response valve (not shown), operated by the detector, to a source of air under high pressure.

Between the photo-electric cells 16 and the suction aperture 14 is an air passage 26 directed downwardly towards the cigarette C1 at an angle of about 45°. FIG. 1 also shows a photo-electric detector 28 at the top of the passageway 2 capable of sensing cigarettes in the passageway 2 at that level.

A full cycle of operations of the apparatus will now be described, commencing with the position shown in FIG. 1, in which a cigarette C4 has been released from the suction aperture 14 of channel 8 and is about to pass into the passageway 2. At this time the cigarette C1 is still held by suction against the aperture 14 of channel 6, while cigarettes continue to be fed into the channels 6 and 8 by the oscillating agitator rollers 12. The next cigarette C2 in channel 6 is at a position where the photo-electric cells 16 illuminate its tobacco end, preferably with infra-red light.

Assuming that the cigarette C2 is satisfactory (i.e. being of full length and having its end well filled with tobacco) there will be a negligible reflection of light from the end of the cigarette, as sensed by the infra-red detector (not shown) at the end of the fibre optic bundle 22. The cigarette C2 will then at the next part of the cycle be allowed to pass to the position of cigarette C1 when automatic control means (not shown) releases that cigarette by disconnection of suction to the aperture 14. At the same time air under pressure is applied to the air passage 26 to assist gravity in accelerating the cigarette C1 down towards the passageway 2.

If, on the other hand, the cigarette C2 is not satisfactory, the infra-red detector operates the fast response valve, connecting the source of high air pressure to the tube 20, thereby allowing air pressure to act against the tobacco end of the cigarette C2 to reject the cigarette through the outlet tube 18.

The control means for the suction apertures 14 of channels 6 and 8 normally operates alternately, so that while suction to the aperture 14 of channel 6 is holding the cigarette C1, suction to the aperture 14 of the channel 8 has been released, allowing the cigarette C4 to drop into the passageway 2 and allowing the next cigarette C5 in channel 8 to drop towards the suction aperture 14 of channel 8; and vice versa.

If a cigarette is rejected, however, for example cigarette C2 from channel 6, the control for the suction aperture 14 is arranged not to release the downstream cigarette (for example cigarette C1) during that cycle; thus the next upstream cigarette in channel 6 (i.e. cigarette C3) drops to the position between the photocells 16 to replace cigarette C2, so allowing sufficient time for its inspection and possible further rejection. In that case after the cigarette C4 from channel 8 has dropped into passageway 2, there will be no cigarette from channel 6, and the cigarette C5 is released at the next cycle, followed only then by cigarette C1.

It may happen that the rejection rate of cigarettes in one of the seven passageways 2 is greater than that in the others, resulting in a gradual drop in the level of cigarettes above the base plate 4. If this trend were allowed to continue, it would clearly be possible to run out of cigarettes in that passageway, resulting in incomplete cigarette groups being formed. To avoid this possiblity, the respective photo-electric detector 28 in that depleted passageway 2 senses the absence of cigarettes and causes the control means to increase the rate at which cigarettes are fed from the channels 6 and 8, relative to the rate of adjacent channels, until the detector 28 again senses that the level of cigarettes has risen to the desired normal position.

Figure 3:
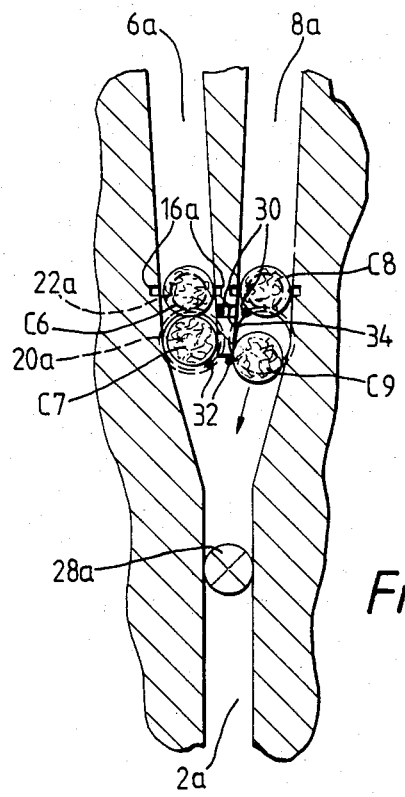
FIG. 3 is a sectional view of a second embodiment of the invention.

Apparatus according to a second embodiment of the invention is shown in FIG. 3, in which some of the parts are similar to those of FIG. 1, and therefore the same reference numerals have been used with the addition of suffix a. In this embodiment cigarettes from channels 6*a* and 8*a* are alternately held up by an escapement mechanism comprising horizontally reciprocating pairs of upper and lower wires 30 and 32, in place of the suction apertures 14. Each of the upper pair of wires 30 in turn passes through a slot 34 in the wall dividing the two channels 6*a* and 8*a*.

In the position shown, the wire 30 for channel 6*a* is in the slot 34 clear of the channel 6*a*, so that it is not supporting the respective cigarette C6, while the wire 30 for channel 6*a* is supporting the opposite cigarette C8 in channel 8*a*. Conversely the lower wire 32 for channel 6*a* is supporting a cigarette C7 (immediately below C6), while the wire 32 for channel 8*a* is clear of a cigarette C9 (below cigarette C8) allowing it to drop into the passageway 2*a*. The two rejection inlet tubes 20*a* are disposed in alignment with the positions occupied by the cigarettes C7 and C9 (prior to its release).

The operation of the apparatus of the second embodiment is as follows: with cigarette C7 supported by the respective wire 32, the cigarette C6 is at a position level with the pair of photo-electric cells 16*a*, behind which is axially disposed the fibre optic detector 22*a*. If, upon illumination of the cells 16*a*, the signal received by the detector 22*a* indicates an unsatisfactory cigarette, when cigarette C6 drops to the position now occupied by cigarette C7 at the next cycle of the escapement mechanism, the cigarette C6 will be rejected by air passing through the tube 20*a*. On the other hand if the cigarette C6 is satisfactory, it will not be rejected at 20*a* but will at the next cycle drop into the passageway 2*a*, in the same manner as cigarette C9 from channel 8*a*.

If desired, the reciprocating mechanism for the wires 30 and 32 may also operate an alternating valve mechanism (not shown) so that only a single control valve is needed for each two tubes 20*a*.

We claim:

1. Apparatus for continuously forming groups of cigarettes, wherein each group has the same predetermined number of cigarettes arranged in the same predetermined number of rows, from a plurality of streams of cigarettes from which defective cigarettes are rejected, said apparatus comprising:

(a) means defining a plurality of downwardly directed passageways each for containing a column of horizontally disposed cigarettes, the number of said passageways corresponding to the number of cigarettes in the longest row of each group;

(b) pusher means for ejecting cigarettes at the bottom of said plurality of passageways in a direction transverse to said passageway to form said groups of cigarettes;

(c) a cigarette hopper mounted above said passageways;

(d) means defining a pair of channels extending between each of said passageways and said hopper, each channel being adapted for receiving horizontally disposed cigarettes from said hopper and having an exit leading to the associated passageway;

(e) escapement means at said exits of each pair of channels adapted to alternately release single cigarettes from said pair of channels through alternate exits;

(f) testing means in each channel for checking at least one end of each cigarette passing therethrough for a defect; and (g) rejection means in each channel connected to said testing means in the respective channel, for rejecting cigarettes having at least one defective end from said channel in a direction transverse to said channel.

2. Apparatus according to claim 1 in which said testing means comprises a fibre optic detector mounted horizontally in axial alignment with a cigarette in said channel to be tested.

3. Apparatus according to claim 2 further comprising a photoelectric cell mounted in each channel to radially illuminate the end of a cigarette to be tested, the illumination being detected by said fibre optic detector.

4. Apparatus according to claim 1 in which said rejection means comprises means for applying compressed air against the end of a faulty cigarette in said channel to reject the cigarette axially.

5. Apparatus according to claim 1 in which said escapement means comprising an inclined surface in each channel having an aperture therein, suction means connected to said aperture to arrest each successive cigarette, and control means to disconnect said suction means alternately from said apertures so that single cigarettes are released alternately from the two channels of a pair.

6. Apparatus according to claim 1 in which said escapement means comprises means extending parallel to said horizontally disposed cigarette and cyclically extensible across said exits of each pair of channels so that at each cyclic movement a cigarette is arrested in one of each of the pairs of channels, while another cigarette previously arrested in the other of the pair of channels is released into the associated passageway.

7. Apparatus according to claim 6 in which said parallel extending means comprises a pair of ladder-like wires reciprocal horizontally across said exits of each pair of channels, said wires being spaced vertically apart by approximately the diameter of a cigarette.

8. Apparatus according to claim 1 further comprising means for applying a downwardly directed jet of air against cigarettes at said exits upon release by said escapement means.

9. Apparatus according to claim 1 comprising a detector mounted towards the upper end of each passageway to detect the level of the column of cigarettes therein and connected to the associated escapement means to control the speed of operation of said associated escapement means in response thereto.

* * * * *